US005956919A

United States Patent [19]

McCracken

[11] Patent Number: 5,956,919

[45] Date of Patent: Sep. 28, 1999

[54] SPANNING MEMBER WITH CONVOLUTED WEB AND C-SHAPED FLANGES

[75] Inventor: Robert G. McCracken, Des Moines, Iowa

[73] Assignee: Wilian Holding Co., Des Moines, Iowa

[21] Appl. No.: 08/926,776

[22] Filed: Sep. 8, 1997

[51] Int. Cl.[6] ..... E04C 3/07

[52] U.S. Cl. ..... 52/729.3; 52/731.7

[58] Field of Search ..... 52/729.3, 729.2, 52/729.1, 690–696, 731.7

[56] References Cited

U.S. PATENT DOCUMENTS

| | | | |
|---|---|---|---|
| 1,860,205 | 5/1932 | Schenker | 52/729.1 |
| 2,312,994 | 3/1943 | Weitzel | 52/729.3 |
| 3,283,464 | 11/1966 | Litzka | 52/729.3 |
| 3,352,077 | 11/1967 | Slusser | 52/729.3 |
| 3,783,569 | 1/1974 | Roussin | 52/480 |
| 4,442,650 | 4/1984 | Sivachenko | 52/694 |
| 4,964,256 | 10/1990 | McCracken | 52/726 |
| 5,012,626 | 5/1991 | Spelten | 52/729 |
| 5,307,601 | 5/1994 | McCracken | 52/364 |
| 5,417,022 | 5/1995 | Ritchie | 52/309.13 |

*Primary Examiner*—Christopher T. Kent
*Attorney, Agent, or Firm*—Davis, Brown

[57] ABSTRACT

A spanning or beam member for use in construction having a pair of opposing C-shaped flanges and a corrugated web. Laterally extended protrusions of the web strengthens the beam member by stiffening the web and increasing the load bearing forces that may be carried by the beam member without crushing. The C-shape of the flanges allows welding of the flanges to the protrusions of the web to reduce the unbraced and unstiffened size of the compression elements to allow for construction of beam members of a given strength out of thinner sheet material.

10 Claims, 8 Drawing Sheets

SPANNING MEMBER WITH CONVOLUTED WEB AND C-SHAPED FLANGES

BACKGROUND OF THE INVENTION

1. Field of the Invention

The invention relates generally to spanning or beam members and, more particularly, to beam members formed of a pair of opposing C-shaped flanges and a convoluted web for added strength.

2. Background of the Art

Beam members are widely used in the construction industry, not only as a permanent building elements but also as a part of construction formwork, such as in scaffolding, concrete forms, and the like. An example of beam members used in formwork include the soldier described in U.S. Pat. No. 4,964,256, which is used as upright and horizontal structural members, inclined braces, columns, shores, and walers. Another example is the lightweight steel beam member used as a support for decking or sheeting as a part of a concrete forming system, as described in U.S. Pat. No. 5,307,601. These beam members are also used as metal studs and other building components where they substitute for conventional dimensional lumber.

Such beam members are made in a wide variety of shapes and designs and of a wide variety of materials. With the widespread use of roll-forming techniques, it has become increasingly common to use beam members that are made of metal sheet material formed primarily by roll-forming to create relatively lightweight yet strong beam members. One way to achieve desired efficiencies and reduce the cost of the beam member is through the use of thinner metal sheet material in the roll-forming process, provided that the resultant beam member is designed to retain the desired strength and other characteristics. The thinner sheet material is less expensive, easier and cheaper to roll-form, and lighter in weight.

SUMMARY OF THE INVENTION

The invention consists of a beam member that has a pair of longitudinally extended and opposing flanges each of which includes a central web section and a pair of inwardly extended leg sections such that each flange is generally C-shaped in transverse cross section. A longitudinally extended web member is interposed between the opposing pair of flanges and has a pair of longitudinally extended sides each of which is in contact engagement along the central web section of a corresponding one of said pair of opposing flanges. The web member has one or more convoluted sections with alternating lateral protrusions that extend transversely across the width or height of the web. The protrusions extend laterally to be adjacent along a portion of a corresponding opposite pair of said leg sections of the flanges. The sides of the web are welded to the flanges at the central web section thereof and the protrusions of the web are welded to the adjacent portions of the leg sections of the flanges. The resultant beam member may be manufactured out of relatively thin sheet material and yet have a high stiffness and weight bearing capacity before crushing.

An object of the present invention is to provide a beam member for use in concrete forming apparatus and also as a building component that will form a permanent part of the constructed building.

Another object of the invention is to provide a beam member with a convoluted web that is roll-formed from a sheet of metal material and having improved stiffness and resistance to crushing under load.

A further object of the invention is to provide a beam member having a corrugated web welded to a pair of opposing flanges that are either U-shaped or C-shaped in transverse cross section to comprise a beam member having improved stiffness and resistance to crushing under load.

Still another object of the invention is to provide a metal beam member that can be used as a replacement for dimensional lumber and includes flanges that are penetrable by scres or hand-driven nails.

These and other objects of the invention will become apparent from a review of the following specification, attached drawings, and appended claims.

DETAILED DESCRIPTION OF A PREFERRED EMBODIMENT

Figure 1:
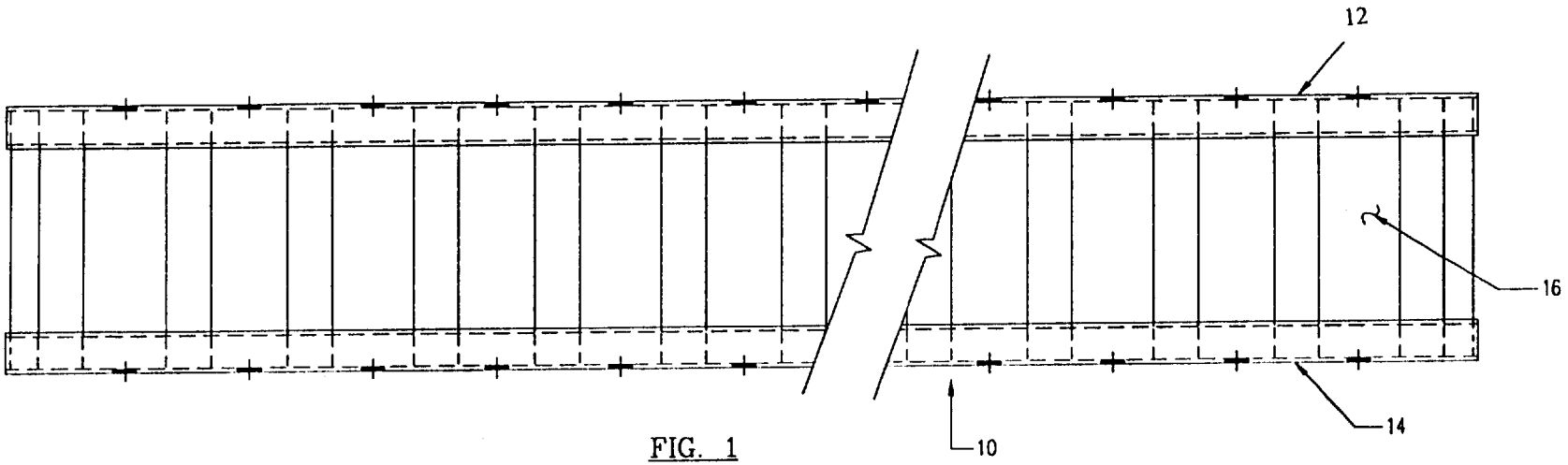
FIG. 1 is an elevational side view of a beam member of the present invention.
Figure 2:
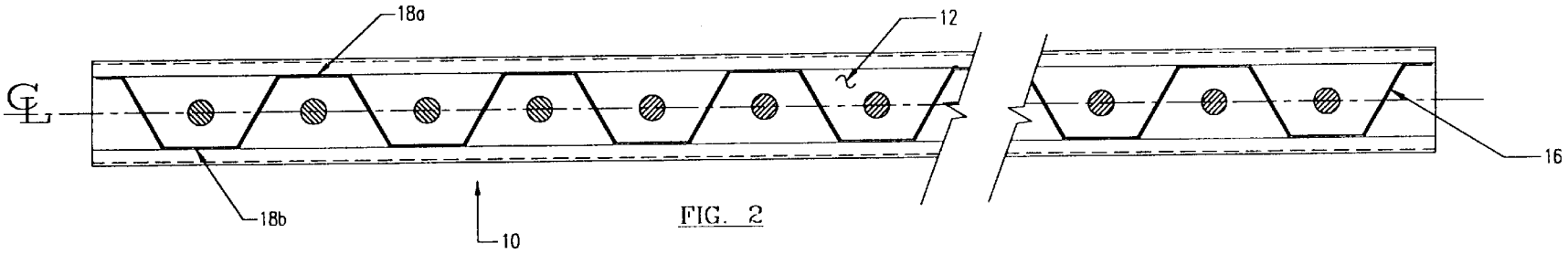
FIG. 2 is a top plan view of the beam member of FIG. 1.

Illustrated in FIGS. 1–4, generally at 10, is a beam member having a pair of opposing flanges 12 and 14. Interposed between the opposing flanges 12 and 14 is a web 16 which, as best illustrated in FIG. 1, has a plurality of alternating, transversely extended protrusions, with the protrusions extending laterally to a first side of the web 16 identified with the reference numeral 18*a* and the protrusions extending laterally to a second side of the web 16 identified with the reference numeral 18*b*.

Figure 5:
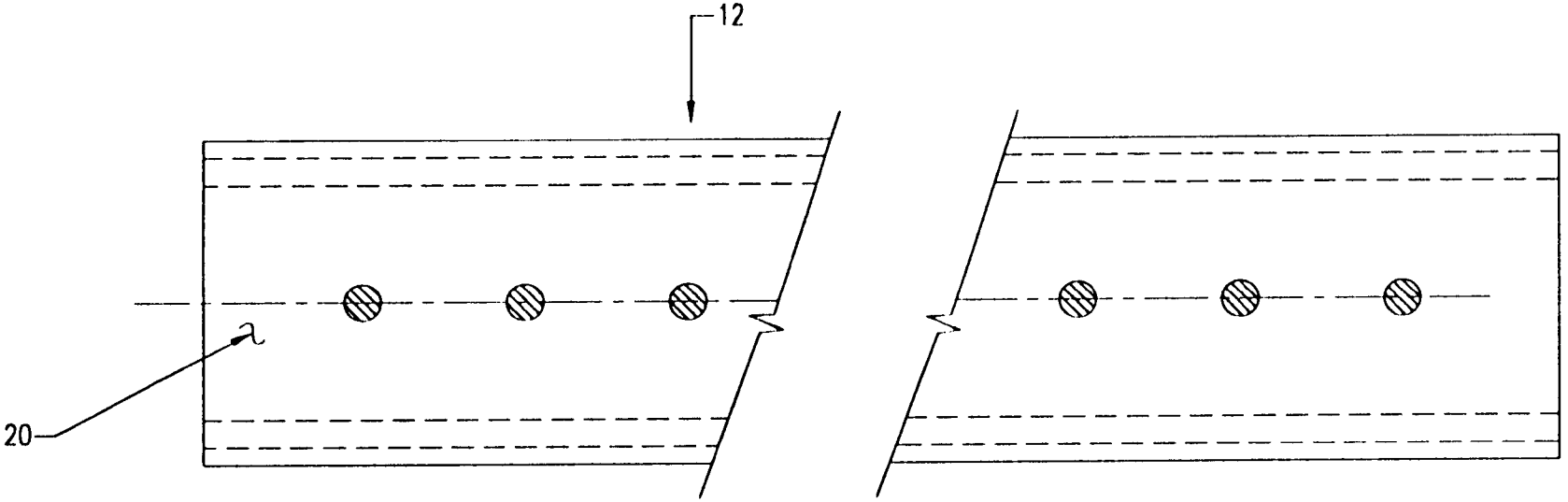
FIG. 5 is a top plan view of a flange member of the present invention.
Figure 6:
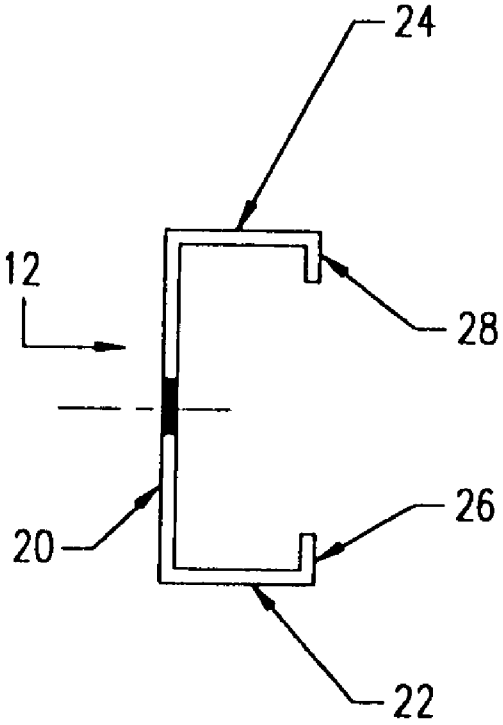
FIG. 6 is an end view of the flange member of the flange member of FIG. 5.

The flanges 12 and 14 are identical, each including a longitudinally extended central web section 20 and a pair of leg sections 22 and 24 that are extended inwardly from either side of the central web section 20 (FIGS. 5 and 6). In the preferred embodiment, the free end portions 26 and 28 of the leg sections 22 and 24, respectively, are turned toward each other so that the flanges 12 and 14 are generally C-shaped in transverse cross-section.

Figure 7:
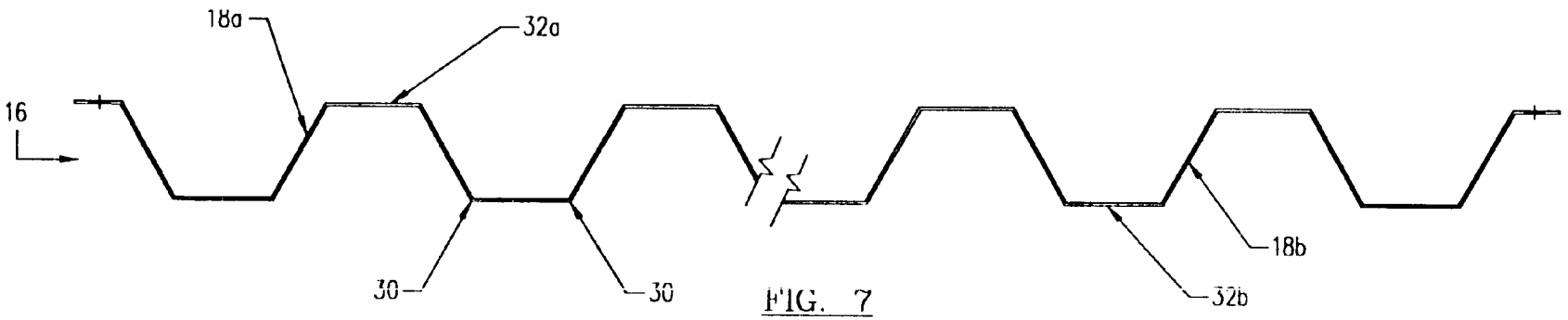
FIG. 7 is a top plan view of a web the present invention.
Figure 8:
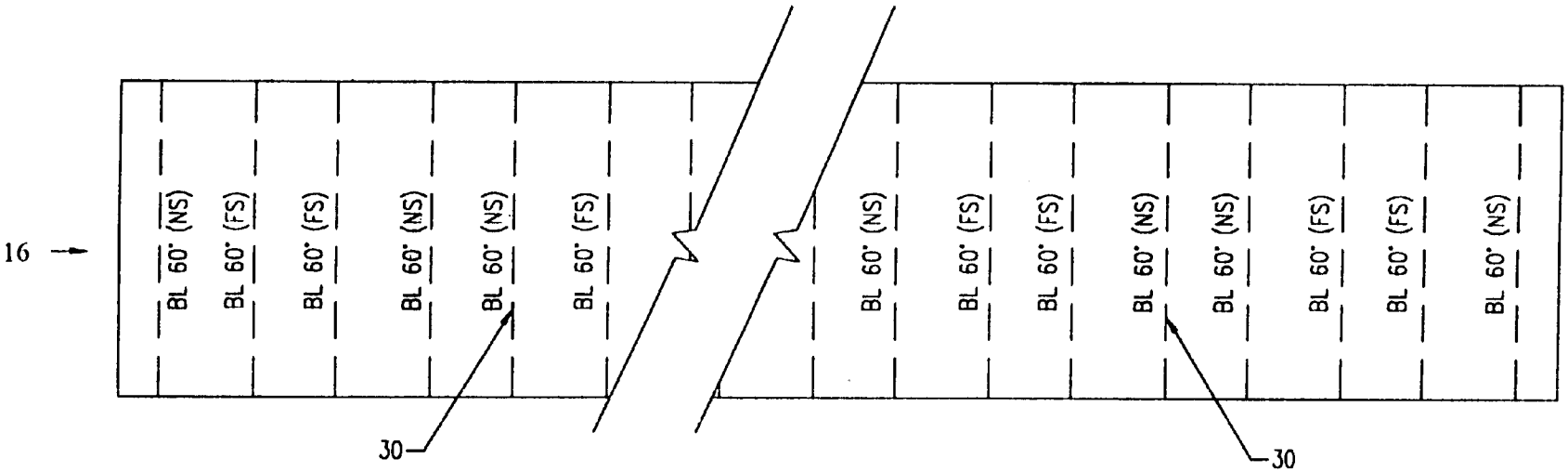
FIG. 8 is a side elevational view of the web of FIG. 7.

The web 16 is formed of a rectangular sheet that has been bent along transverse lines perpendicular to the longitudinal axis of the sheet. The bends, indicated at 30 in FIG. 8, alternate in direction at intervals to produce at least a section of the web 16 having a convoluted or corrugated shape wherein the protrusions 18*a* and 18*b* extend to either side of the web 16 (FIG. 7). In the preferred embodiment, the protrusions 18*a* and 18*b* are symmetrical and have flat outer sections 32*a* and 32*b*, respectively, that are laterally spaced by a distance that matches the transverse distance or spacing between the free end portions 26 and 28 of the leg sections 22 and 24 of the flanges 12 and 14. Accordingly, upon assembly of the web 16 and flanges 12 and 14, the flanges 12 and 14 will fit over the longitudinally extended sides of the web 16 with the side edges of the web 16 in flush contact engagement with the central web section 20 of each of the flanges 12 and 14 and with the flat outer sections 32*a* and

Figure 3:
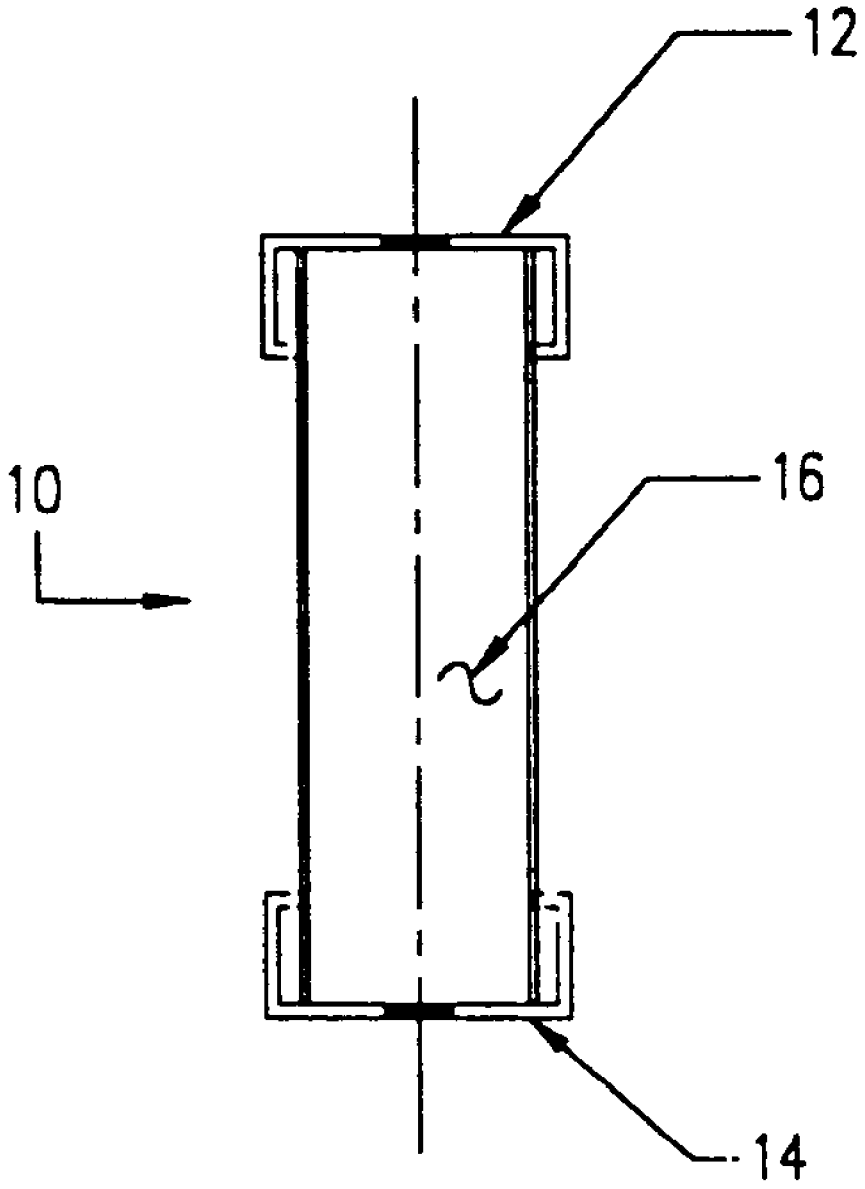
FIG. 3 is an end view of the beam member of FIG. 1.

32*b* of the protrusions adjacent the free end portions 26 and 28 of the flange leg sections 22 and 24 (FIG. 3).

Figure 4:
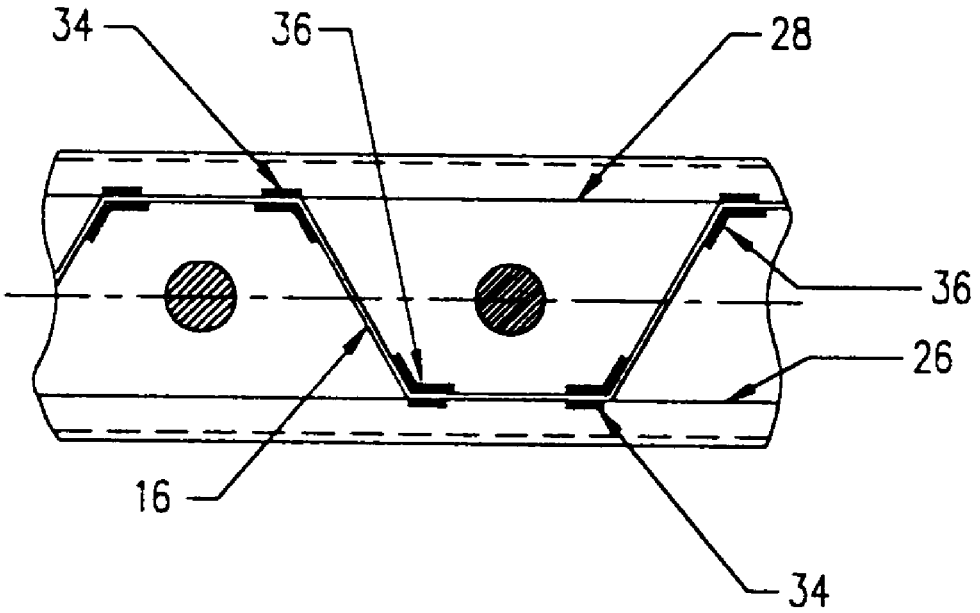
FIG. 4 is an enlarged detail view showing weldments securing the web of the beam member to flanges of the beam member.

To complete the beam member 10, the flanges 12 and 14 are preferably welded to the web 16. As illustrated in FIG. 4, the flat outer sections 32*a* and 32*b* of the protrusions 18 are welded at 34 to the free end portions 26 and 28 of the flange leg sections 22 and 24, and the side edges of the web 16 are welded at 36 to the central web section 20 of each of the flanges 12 and 14. In the resulting assembly, the convoluted web 16 provides stiffened members over the points of support to resist crushing of the beam member 10 under load resting on the top flange. In addition, the inwardly extended leg sections 22 and 24 permit welding to the web 16 at points inward of the central web section 20 to reduce the unbraced and unstiffened size of the compression elements to allow the use of thinner metal sheet material in the manufacture of the beam member 10.

In the preferred embodiment, the protrusions 18 are formed using alternating bends of approximately 120°, with the flat sections 32 of a length of 62.5 mm separated by 73 mm. This results in a corrugated web 16 that has an outside lateral width of 65 mm. The flanges 12 and 14 are formed using 90° bends with a central web section 20 of 89 mm in width, wherein the leg sections 22 and 24 extend transversely inwardly 36 mm and the free end sections 26 and 28 extend laterally inwardly 12 mm so that the gap between opposing free end sections is 65 mm. The web 16 are roll-formed from high strength, low alloy sheet steel having a thickness of 0.0598 inches (16 gauge) and the flanges 12 and 14 are roll-formed from high strength, low alloy sheet steel having a thickness of 0.0747 inches (14 gauge). A beam member 10 with these dimensions is suitable for use as a replacement for 3½ inch wide lumber in garage door headers, window headers, and other long spanning applications in residential construction, wherein it is important to note that the flanges 12 and 14 are penetrable by screws or hand-driven nails for the attachment of other building components as with lumber. The beam members are also intended for use in the concrete forming industry where they are currently used to support concrete forms in horizontal forming applications. Beam members of the present invention will generally serve as an intermediary supporting member between other components of concrete forming systems apparatus.

Although the preferred embodiment has been described as having the web and flanges manufactured from specified sheet material, sheet materials of different thicknesses or other characteristics may be used depending on the desired performance characteristics of the resulting beam member. Additionally, while the protrusions or corrugations of the web in the preferred embodiment are comprised of straight or flat sections made by a series of bends across the full transverse width of the sheet, other diverse convolutions could be used. For example, a sinusoidal pattern, or truncated sinusoidal pattern, could be used. Additionally, in the preferred embodiment, the convoluted section extends the full length of the web, whereas it may be desirable to provide one or more convoluted sections that are less than the full length. Further, while flanges of a generally C-shape are used in the preferred embodiment, flanges of a U-shaped cross section could be employed, albeit with some loss in strength and possible added material costs.

Although the invention has been described with respect to a preferred embodiment thereof, it is to be also understood that it is not to be so limited since changes and modifications can be made therein which are within the full intended scope of this invention as defined by the appended claims.

I claim:

1. A beam member, comprising:

a. a pair of longitudinally extended and opposing flanges each of which is comprised of a central web section and a pair of inwardly extended leg sections on opposite sides of said central web section;

b. a longitudinally extended web member interposed between said opposing pair of flanges and having a pair of longitudinally extended sides each of which is in contact engagement along the central web section of a corresponding one of said pair of opposing flanges;

c. said web member comprising one or more convoluted sections with alternating protrusions that extend laterally and are adjacent along a portion thereof to a corresponding opposite pair of said leg sections of said flanges; and d. means for securing said sides of said web member to said central web section of said flanges and for securing said protrusions to said adjacent leg sections of said flanges.

2. A beam member as defined in claim 1, wherein said web member and said flanges are coextensive in length.

3. A beam member as defined in claim 1, wherein said web member is formed of a sheet of metal and said flanges are formed of a sheet of metal.

4. A beam member as defined in claim 3, wherein said sheet of metal for forming said web member has characteristics that are distinct from the characteristics of said sheet of metal for forming said flanges.

5. A beam member as defined in claim 4, wherein said sheet of metal for forming said web member has a thickness that is distinct from the thickness of said sheet of metal for forming said flanges.

6. A beam member as defined in claim 1, wherein said means for securing said web member to said flanges comprises weldments.

7. A beam member as defined in claim 1, wherein said means for securing said protrusions to said leg sections comprises weldments joining said adjacent portions of said protrusions and said leg sections.

8. A beam member as defined in claim 1, wherein said flanges are adapted to be penetrable by hand-driven fasteners.

9. A beam member, comprising:

a. a pair of opposing, generally C-shaped flanges, each of which comprises, i. a longitudinally extended central web section having a pair of opposite side portions, ii. a pair of leg sections, one each of which extends inwardly from a corresponding one of said opposite side portions of said central web section and, iii. an inturned portion of each of said leg sections;

b. an upright web interposed between said opposing flanges and having a pair of opposite side portions that are in contact engagement with a central web section of a corresponding one of said flanges;

c. one or more convoluted sections of said web comprising laterally extended, alternating protrusions, any alternating pair of which substantially spans the distance between said pair of leg sections of each of said flanges; and d. means for securing said side portions of said upright web to a corresponding one of said central web sections of said flanges and means for securing said protrusions to said leg sections.

10. A beam member as defined in claim 9, wherein said flanges are adapted to be penetrable by hand-driven fasteners.

* * * * *